United States Patent [19]

Abrams, III

[11] 4,209,867

[45] Jul. 1, 1980

[54] FLEXIBLE SURFBOARD

[76] Inventor: Henry H. Abrams, III, 15 Community Rd., Bay Shore, N.Y. 11706

[21] Appl. No.: 888,492

[22] Filed: Mar. 20, 1978

[51] Int. Cl.[2] ..... A63C 15/00

[52] U.S. Cl. ..... 9/310 E; 280/610; 428/106

[58] Field of Search ..... 9/310 R, 310 B, 310 E, 9/310 F, 6 R, 6 P, 6 W; 428/57, 61, 98, 106, 116, 119; 280/608, 610

[56] References Cited

U.S. PATENT DOCUMENTS

| | | | |
|---|---|---|---|
| 1,872,230 | 8/1932 | Blake | 9/6 R X |
| 3,289,227 | 12/1966 | Kelly, Jr. | 9/310 E |
| 3,355,183 | 11/1967 | Kneissl | 280/608 |
| 3,372,945 | 3/1968 | Salisbury | 9/310 E X |
| 3,378,275 | 4/1968 | Rockwood et al. | 9/310 B X |
| 3,416,810 | 12/1968 | Kennedy | 280/610 |
| 4,131,705 | 12/1978 | Kubinsky | 428/106 |
| 4,137,354 | 1/1979 | Mayes, Jr. et al. | 428/116 |

FOREIGN PATENT DOCUMENTS

| | | | |
|---|---|---|---|
| 852547 | 10/1960 | United Kingdom | 428/106 |

OTHER PUBLICATIONS

Popular Mechanics; Frank Follmer and Tom Riley; "Boards for Surf and Sail"; Jul., 1958; pp. 168-172.

*Primary Examiner*—Trygve M. Blix
*Assistant Examiner*—Winston H. Douglas
*Attorney, Agent, or Firm*—Karl F. Ross

[57] ABSTRACT

A lightweight flexible, hollow surfboard having top and bottom decks, at least one of which is made from sheet balsa having the grain perpendicular to a broad surface thereof with a coating of synthetic resin laminated to that surface and spacing means between the top and bottom decks. At least one rail sheet spans the decks and extends along the entire periphery of the surfboard to define a closed, hollow interior. A stabilizer extends downwardly from the bottom deck.

6 Claims, 4 Drawing Figures

FLEXIBLE SURFBOARD

FIELD OF THE INVENTION

The present invention relates, in general, to surfboards and, more particularly, to a surfboard having high flexibility, light weight, and dimensional stability.

BACKGROUND OF THE INVENTION

Surfboard having some of the above features are already known in the art.

For instance, surfboards which are lightweight can be made from expanded synthetic-resin foam covered with a tough skin of synthetic resin. Also falling into this class are surfboards made of solid balsa which is carved to shape. However, neither the foam or balsa types have high flexibility, or any significant bending flexibility for that matter. Hollow surfboards are also known and are usually made of woods other than balsa, as well as of balsa with the grain parallel to the broad surfaces. They have advantages in that they are also lightweight and have limited flexibility because of their hollow interiors.

It has been found in the surfing art that high flexibility in a surfboard increases the maneuverability of that board so that higher flexibility, buoyancy, and dimensional stability must be combined for greatest control, maximum speed and most effective performance in surfing for pleasure or in competition.

OBJECTS OF THE INVENTION

It is therefore an object of the present invention to provide an improved surfboard which is highly flexible.

It is another object of the present invention to provide an improved surfboard which is of light weight.

It is still another object of the present invention to provide a surfboard with improved flexibility combined with dimensional stability.

SUMMARY OF THE INVENTION

The above and other objects of the invention are attained in a surfboard having a top deck spaced from a bottom deck by a spine and ribs (spacing means) arranged therebetween and a pair of rail sheets spanned between the top and bottom decks and extending along the periphery of the decks to define a surfboard having an enclosed hollow interior with a tail fin (stabilizer) extending downwardly from the bottom deck.

The top and bottom decks as well as the rail sheets are formed, according to a key feature of the invention, from sheet balsa having a grain perpendicular to the broad surfaces thereof and laminated on one of the broad surfaces with a coating of synthetic resin which can include fiber-glass sheets or glass fibers dispersed therein. The decks and rail sheet are arranged during assembly of the surfboard so that this coating faces the interior of the surfboard.

The spine and ribs are formed from another balsa sheet having the grain perpendicular to the broad surfaces thereof and laminated on both broad surfaces with a coating of synthetic resin which also can include glass fibers or fiber-glass sheets.

The rail sheets as well as the spine and ribs can be provided with a plurality of cuts spaced along the respective upper and lower edges of these members, the cuts being made at an angle to these edges and serving to impart a much greater flexibility to these members without sacrificing the structural integrity thereof.

The tail fin, which is also highly flexible, is formed from sheet balsa such as that already described, and comprises two mirror-symmetrical identical halves which are joined at one of their broad surfaces by a coating of synthetic resin, which can include fiber-glass, laminated between these halves.

In the assembly of the surfboard, the spine and ribs are arranged on the interior coated surface of the bottom deck and bonded thereto, with the broad surfaces of these members perpendicular to the bottom deck. The spine can be one continuous piece or separated into individual sections, as can the ribs, which lie between the spine and the periphery of the decks, and in one embodiment of the invention, extend continuously between the spine and the peripheral edges and are bonded to the spine at an angle. The top deck is then placed with its coated surface on the spine and rib structure and bonded thereto in a spaced apart relationship with the bottom deck.

In the next step of the assembly method, the rail sheets are positioned in place on the peeriphery of the decks and bonded to the edges thereof and to the ends of the ribs, if they extend to the edges.

The tail fin is now bonded to the bottom deck and extends downwardly therefrom, this being the last step in the assembly of the surfboard, which is then laminated over its entire exterior surface, including the tail fin, with a coating of synthetic resin which can include glass fibers or fiber-glass sheets.

The surprising advantage of using sheet balsa with the grain perpendicular to the broad surfaces is that one can obtain practically omnidirectional flexibility, so that the surfboard can bend front to back as well as twist from side to side, such flexibility being very necessary to the maneuverability of the surfboard, while the skeletal structure defined by the spine and ribs adds strength to the surfboard without compromising the flexibility thereof and at the same time produces a surfboard which is very tight and bouyant with high dimensional stability. The synthetic resin coatings laminated to the interior and exterior surfaces of the surfboard also add strength and provide waterproofing.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
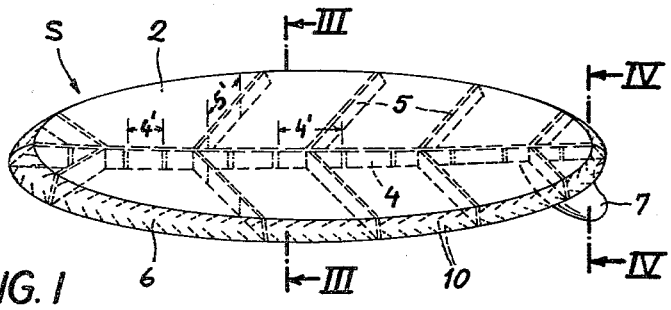
FIG. 1 is a perspective view of the surfboard according to the invention showing the interior skeletal structure in phantom lines.
Figure 2:
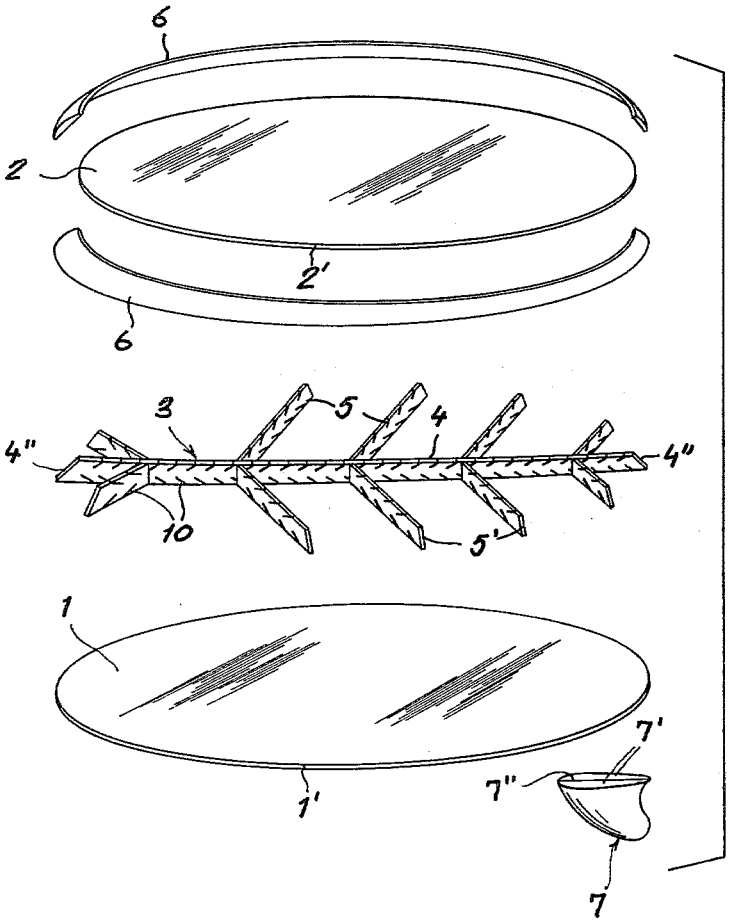
FIG. 2 is an exploded perspective view of the surfboard of FIG. 1 showing the various members of the assembly.

As can be seen in FIGS. 1 and 2, the surfboard S has an elongated, substantially oval bottom deck 1 and top deck 2, the deck 2 being slightly smaller than the deck 1 and spaced therefrom by a skeletal structure 3 comprising a spine 4 and a plurality of ribs 5, which are bonded to the decks 1 and 2. A pair of rail sheets 6 span between the peripheral edges 1' and 2' of respective decks 1 and 2 and extend along the peripheral length of the surfboard S to completely define an enclosed hollow interior. A tail fin 7 is provided on the bottom deck 1 and projects downwardly therefrom.

Figure 3:
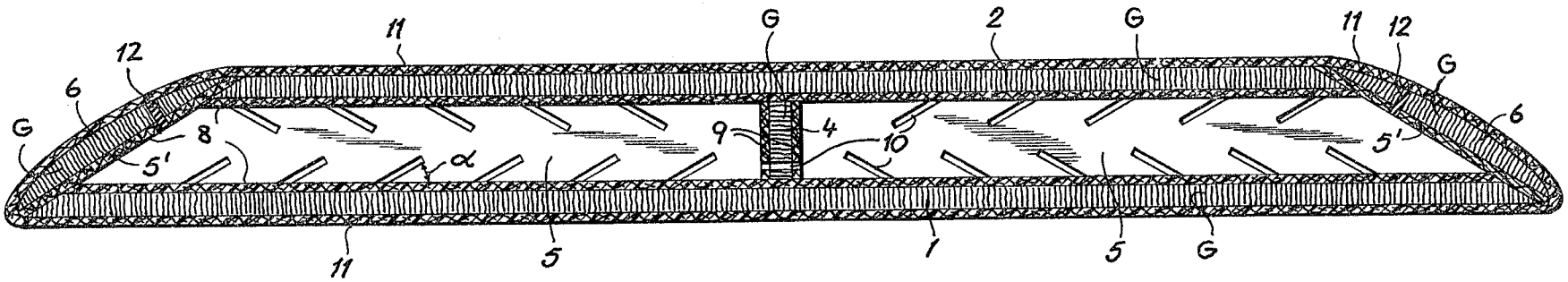
FIG. 3 is a sectional view taken along line III—III of FIG. 1 with the thickness of the synthetic resin coatings exaggerated.
Figure 4:
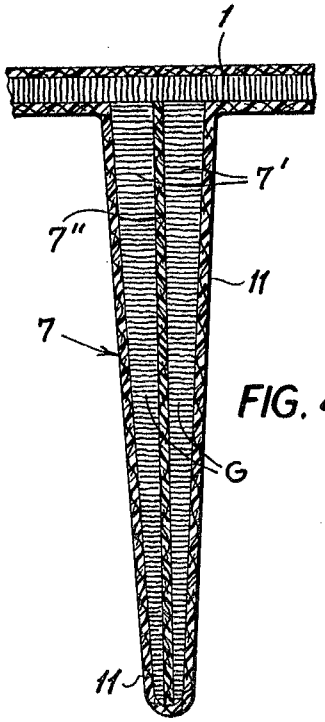
FIG. 4 is a sectional view taken along line IV—IV of FIG. 1 with the thickness of the synthetic resin coatings exaggerated.

The top and bottom decks 1 and 2 as well as the rail sheets 6 are formed from sheet balsa having the grain G perpendicular to the broad surfaces thereof, as can be seen in FIG. 3 and laminated on one of the broad surfaces with a coating 8 of synthetic resin which includes fiber-glass sheets, the respective members 1,2 and 6 being arranged during the assembly of the surfboard S with the coatings 8 facing the hollow interior of the surfboard.

The spine 4 and ribs 5 are also formed from a balsa sheet having the grain G perpendicular to the broad surfaces thereof and laminated on both broad surfaces with a coating 9 of synthetic resin and fiber-glass sheets. As can be seen in FIG. 1, the spine 4 can be one continuous piece or separated into individual sections 4', as indicated in dot-dash lines and can extend longitudinally the length of the surfboard S along the center thereof. The ribs 5 can extend at an angle from the spine 4 to the edges 1' and 2' of the decks, the ribs 5 being of different lengths depending upon their location along the spine 4. In an alternative embodiment of the invention, the ribs 5 can be individual sections 5', as shown in dot-dash lines, which lie between the spine 4 and edges 1' and 2'.

The rail sheets 6, spine 4 and ribs 5 are provided with a plurality of cuts 10 spaced along the respective upper and lower edges of these members, the cuts being made at angle $\alpha$ to the edges ranging between 15° and 60°.

The tail fin 7 comprises two mirror symmetrically identical halves 7' which are formed from an uncoated sheet of balsa having the grain G perpendicular to the broad surfaces thereof, the halves 7' being joined along a broad surface by a coating 7'' of synthetic resin and fiber-glass laminated between the halves and the tail fin 7 bonded to the bottom deck 1.

In the assembly of the surfboard S, the bottom deck is placed with the coating 8 facing upwardly and the spine 4 and ribs 5 are arranged on the coating 8 to form the skeletal structure 3, which is then bonded to the coating. The top deck 2, with its coating 8 facing downwardly, is positioned on the skeletal structure 3 to lie within the outline of the bottom deck 1 and bonded to the structure 3. The ends 5' of the ribs 5 and ends 4'' of the spine 4 are then trimmed to lie flush with the edges 1' and 2' and the rail sheets 6 are positioned in place along the periphery and bonded to the edges 1' and 2' as well as the rib ends 5' and the spine ends 4'', the rail sheets lying at an angle to the decks 1 and 2 due to the slight difference in size of these decks. The tail fin 7 is then bonded to the bottom deck 1, this being the last step in the assembly of the surfboard S.

After assembly of the surfboard S, all of the exterior surfaces of the surfboard, including the tail fin 7, are laminated with a coating 11 of synthetic resin and fiber-glass. However, prior to this step, the cuts 10, formed in the rail sheets 6, are filled with a resilient substance 12, such as rubber cement, (which can be removed later) to prevent the synthetic resin coating 11 from entering the cuts 10 during the laminating step and hardening, thereby limiting the flexibility of the rail sheets 6.

It is to be understood that after the assembly of the surfboard, a certain amount of shaping and sanding is necessary before the application of the coating 11, which in turn may require polishing and waxing after the coating hardens.

It should also be pointed out that in another embodiment of the invention, the ribs 5 can be eliminated entirely to achieve a particular performance characteristic of the surfboard; it is possible to substitute metal members or those made from a material other than balsa for some of the members described, except as otherwise required by the claims.

In the foregoing, the term "synthetic resin" is used to refer to any synthetic-resin material suitable for the coating of structures adapted to come into contact with water and having a limited frictional resistance thereto. Generally speaking, the synthetic resin can be a polyester or epoxy which is filled with glass fibers and/or is resinforced by glass-fiber webs or sheets in the manner previously described. In addition, each "coating" or "layer" may consist of a number of layers successively applied. Also, while I may have referred to the cutting of a particular structural member from sheet balsa having the grain running perpendicular to the end surface, it will be apparent that this sheet balsa can either be previously coated with glass fiber reinforced synthetic resin (as defined immediately above) on one or both surfaces so that the cutting is effected upon the laminate. Alternatively, only one of the broad surfaces may be coated before the member is cut out or the synthetic resin can be applied to the remaining surface or to both surfaces after the member has been cut from the broad surface.

I claim:

1. A surfboard comprising:

an elongated substantially oval deck structure having upper and lower broad surfaces and composed at least in part of balsa wood having the grain perpendicular to said broad surfaces and enclosed in a hardened layer of fiberglass-containing synthetic resin; and a generally flat stabilizer extending downwardly from said lower broad surface at one end of said deck structure and secured thereto, said stabilizer comprising two mirror symmetrical halves formed from sheet balsa having the grain perpendicular to a broad surface of each of said halves and parallel to said lower broad surface, said halves being joined at the broad surfaces thereof by a coating of synthetic resin laminated therebetween.

2. A surfboard as defined in claim 1 wherein said deck structure comprises:

an elongated, substantially oval bottom deck;

an elongated, substantially oval top deck slightly smaller than said bottom deck and spaced from said bottom deck within the outline thereof, both of said decks being made of sheet balsa having the grain perpendicular to a broad surface thereof and a coating of synthetic resin laminated to said surface;

spacing means between said bottom deck and said top deck for holding said decks apart;

at least one rail sheet spanning between the peripheral edge of said top deck and the peripheral edge of said bottom deck, said spacing means comprising a spine extending longitudinally over at least a portion of said surfboard, said spine being made of sheet balsa having the grain perpendicular to the broad surfaces thereof and parallel to said top and bottom decks and a coating of synthetic resin laminated to the latter surfaces; and ribs between said spine and the periphery of said surfboard and extending over at least a portion of the distance therebetween, said ribs being made of sheet balsa having the grain perpendicular to the broad surfaces thereof and parallel to said top and bottom decks and a coating of synthetic resin laminated to the latter surfaces.--

3. The surfboard defined in claim 2 wherein said rail sheet is made of sheet balsa having the grain perpendicular to a broad surface thereof, said rail sheet forming an angle with said top and bottom decks, the latter broad surface having a coating of synthetic resin laminated thereto.

4. The surfboard defined in claim 3, wherein said rail sheet, said spine, and said ribs are formed with a plurality of spaced cuts along their respective upper and lower edges, said cuts being arranged at an angle to said upper and lower edges.

5. The surfboard defined in claim 3 wherein said rail sheet comprises two spectrally identical halves, each extending along half the periphery of said edge of said top and bottom decks.

6. The surfboard defined in claim 5, wherein the synthetic resin laminated to said respective surfaces of said top and bottom decks, said rail sheets, said spine, and said ribs includes fiber-glass sheets.

* * * * *